United States Patent [19]

Bascou

[11] Patent Number: 4,524,594

[45] Date of Patent: Jun. 25, 1985

[54] RETRACTABLE KEY CARRIER

[75] Inventor: Jacques Bascou, Maule, France

[73] Assignee: Regie Nationale des Usines Renault, Boulogne-Billancourt, France

[21] Appl. No.: 473,748

[22] Filed: Mar. 9, 1983

[30] Foreign Application Priority Data

Mar. 9, 1982 [FR] France ..... 82 03910

[51] Int. Cl.[3] ..... A44B 15/00; A45C 11/32; A47G 29/10

[52] U.S. Cl. ..... 70/456 R; 70/459

[58] Field of Search ..... 70/456 R, 456 B, 457, 70/459; 150/40; 220/253

[56] References Cited

U.S. PATENT DOCUMENTS

| | | | |
|---|---|---|---|
| 2,248,436 | 7/1941 | Rivers | 70/456 R |
| 2,300,979 | 11/1942 | Simpkins | 70/456 R |
| 2,411,168 | 11/1946 | Seely | 70/456 R |
| 2,560,595 | 7/1951 | Poncar | 70/456 R |
| 2,822,684 | 2/1958 | Ray | 70/456 R |
| 2,863,312 | 12/1958 | Groulx | 70/456 R |
| 3,355,917 | 12/1967 | Albert | 70/456 R |
| 4,141,461 | 2/1979 | La Chance | 220/253 |

*Primary Examiner*—Gary L. Smith
*Assistant Examiner*—Russell W. Illich
*Attorney, Agent, or Firm*—Oblon, Fisher, Spivak, McClelland & Maier

[57] ABSTRACT

A key carrier includes an electromagnetic wave transmitter and a key. The key is pivotally mounted within a drum rotatably mounted in the key case. When the drum is rotated so that an opening of the drum is in alignment with an opening of the case, a spring mounted between the key and the drum biases the key out of the case. When the drum is rotated so that the openings are out of alignment, a stop surface of the case retains the key within the drum. A second spring is provided for biasing the drum such that the openings are out of alignment. A manual control wheel is provided for rotating the drum so that the openings are in alignment, so that the key can be extracted from case.

9 Claims, 9 Drawing Figures

RETRACTABLE KEY CARRIER

BACKGROUND OF THE INVENTION

1. Field of the Invention

The present invention concerns a key carrier of the type comprising a key which can be retracted into a case provided with an opening through which the functional portion of the key can exit for use.

2. Description of the Prior Art

Certain automobiles are now equipped with a control device for unlocking the doors, the device comprising a infrared wave transmitter in the possession of the vehicle driver and a receiver mounted in the vehicle. However, if the control device breaks down, it is necessary that the driver has a key at his disposal which allows him to unlock the doors in a conventional fashion. Until the present, this key has been connected to the transmitter case by a ring and the transmitter casing body has constituted a key carrier for this key and, optionally, for the ignition key of the vehicle. It seemed desirable, in order to reduce the bulk of this key-casing unit of the transmitter, to be able to retract the emergency key into the transmitter case.

SUMMARY OF THE INVENTION

The invention proposes a key carrier of the type comprising a key which can be retracted into a case provided with an opening through which the key body can exit, characterized in that one end of this key is mounted on a pin about which it can pivot by a predetermined angle in order to exit from the case.

According to another characteristic of the invention, the key carrier includes elastic means which act on the key to cause it to pivot about its pin toward a surface for positioning the key, blocking means which allow the key to be retained in the case by opposing the action of the elastic means, and manual control means which allow the blocking means to be acted on.

By means of such a structure the key contained in the case can be brought out automatically by a simple action on the part of the user on the control means.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 2:
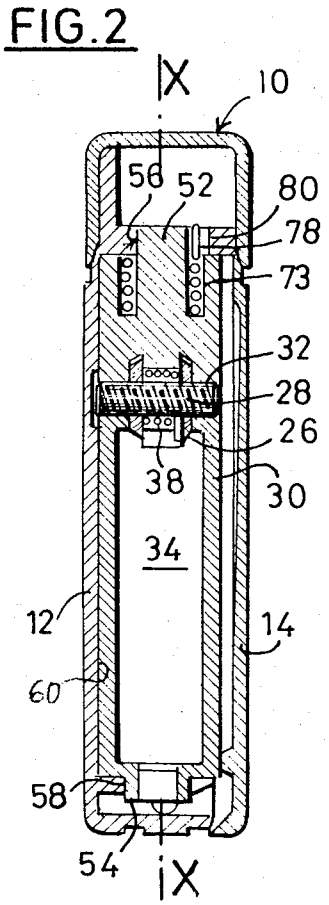
FIG. 2 is a sectional view along line 2—2 of FIG. 1.

The key carrier shown in FIG. 1 to 9 has a case 10 with the general shape of a rectangular parallelepiped.

Case 10 has a lower part constituted by bottom 12 and flat rectangular cover 14, and an upper part constituted by parallelpipedic cover 16.

Case 10 contains a retractable key 18, e.g. for controlling the unlocking of an automobile door lock, and a second control device for unlocking door locks of the vehicle. In the embodiment shown, this second device is constituted by an infrared wave transmitter which cooperates with a receiver (not shown) integrated into the vehicle. The infrared wave transmitter is only shown in a schematic fashion. Its chief components are emitter bulb 19 and batteries 20.

The structure for permitting the key 18 of case 10 to be extended if the infrared wave transmitter breaks down will now be described in detail.

Key 18 has a function body 22 which can be introduced into a lock (not shown), and a gripping head constituted by case 10 itself.

Rectangular opening 24 is formed in a side wall of case 10.

Figure 1:
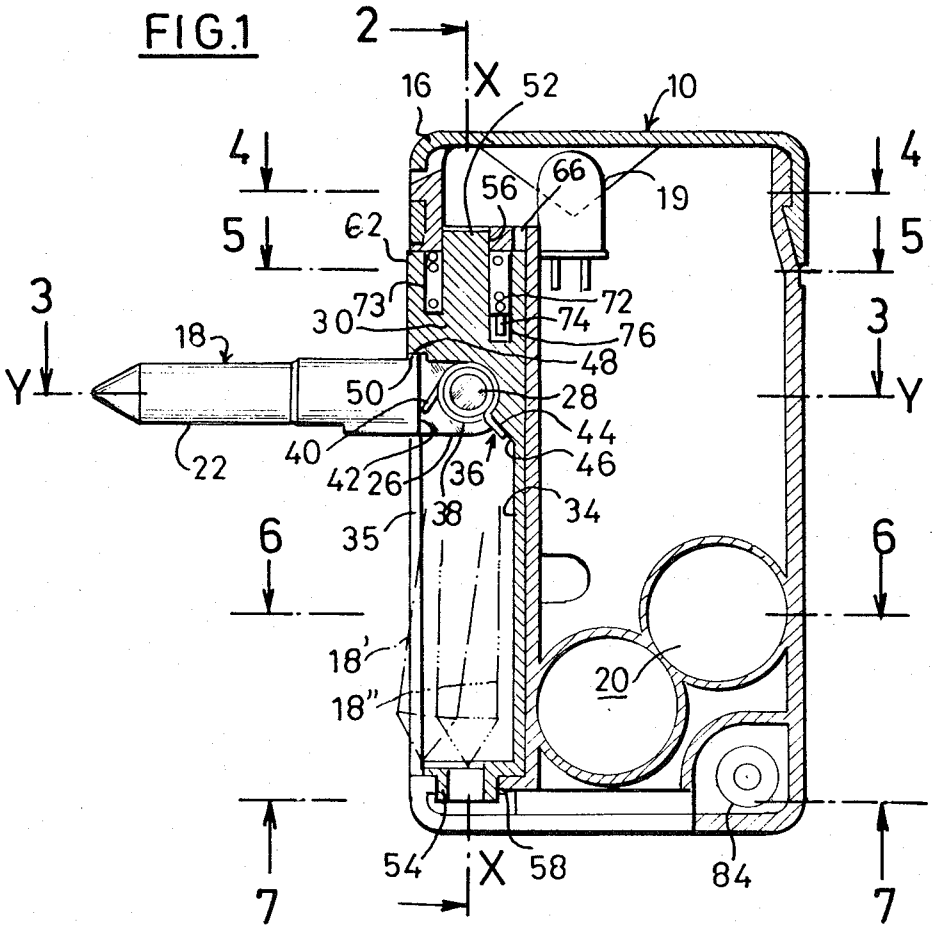
FIG. 1 is a sectional view of a key carrier constructed in accordance with the teachings of the present invention and in which the key is shown in its extended position.

According to the invention, end 26 of the body 22 of key 18 is pivotably mounted in case 10 by means of pin 28. Key 18 can pivot about pin 28 in order to exit from case 10 through opening 24. FIG. 1 shows the key in extended position in solid lines, an intermediate position 18' of the key in dotted lines and the fully retracted position at 18'' in dotted lines. In the examples shown, key 22 pivots about pin 28 by an angle of 90° between extended position 18 and fully retracted position 18''. Pin 28 is not mounted directly in case 10 but rather in a drum 30 which is itself mounted so that it can rotate in case 10 in a manner described below. Pin 28 is mounted in bore 32 of drum 30. The direction of bore 32 and thus of pin 28 is perpendicular to the general axis X—X of drum 30 about which the latter can rotate. As can be seen from FIG. 1, the general axis Y—Y of key body 18'' coincides with axis X—X of the drum when the key is in fully retracted position in space 34 provided for this purpose in drum 30. The key can exit or return through rectangular axial window 35 cut in the cylindrical wall of drum 30.

According to the invention, elastic means 36 are provided to bias body 22 of key 18 to pivot about pin 28 in the direction corresponding to the extension of the key. Elastic means 36 are constituted by spiral spring 38 wound about pin 28. A first end 40 of spiral spring 38 bears on flat surface 42 formed on body 22 of key 18. The second end 44 of spring 38 bears on support surface 46 formed on drum 30 at the upper part of space 34. Under the action of spiral spring 38, key 18 is held in contact with positioning surface 48 formed on the upper contour of window 35 of drum 30. Positioning surface 48 cooperates with a corresponding surface 50 formed on body 22 of key 18 in order to define precisely the predetermined pivoting angle of the key about pin 28 and the extended position of the key in relation to case 10.

According to another characteristic of the invention, blocking means are provided for retaining key 18 inside drum 30, and so inside case 10, and for preventing key 18 from pivoting around pin 28 under the action of spiral spring 38 at the wrong time. These blocking means are constituted by the rotary mounting of drum 30 in case 10 and by the possibility which is thus offered of being able to mask window 35 of drum 30, thus completely retracting key 18.

Figure 3:
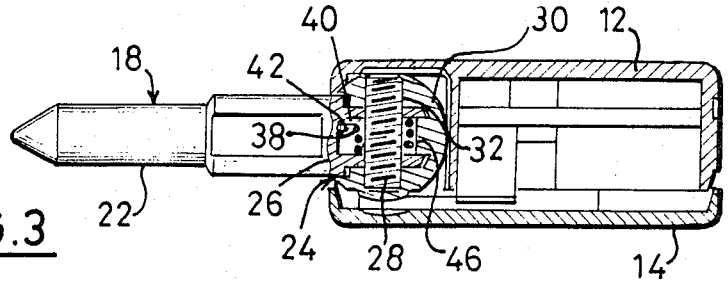
FIG. 3 is a sectional view along line 3—3 of FIG. 1.

Drum 30 is rotatably mounted in case 10 by means of upper trunnion 52 and lower trunnion 54, which are received in bores 56 and 58 formed in case 10. Drum 30 can thus rotate about its axis X—X in relation to case 10 when the key is in its fully retracted position 18", that is, when axis Y—Y coincides wiht axis X—X. In this position, body 22 of key 18 no longer cooperates with the edge of opening 40 and therefore does not oppose the rotation of drum 30. The position of drum 30 in case 10, defined by the location of bores 56 and 58, is selected in such a manner that when window 35 is opposite opening 24, the edge of window 25 contains the edge of opening 24, as can be seen in FIG. 3.

Figure 6:
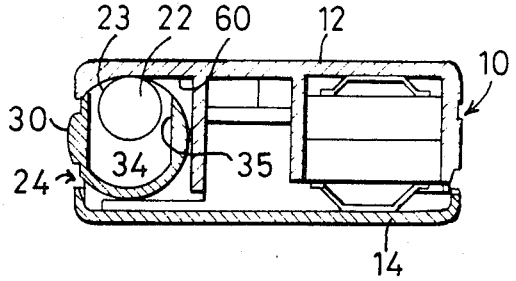
FIG. 6 is a sectional view along line 6—6 of FIG. 1, whereby the key is in its retracted position.

When the drum occupies the position shown in FIG. 6, i.e. when it has executed a rotation of 90° in a clockwise direction about its axis X—X from the position which it occupies in FIG. 1, opening 35 is located opposite stop surface 60 formed inside case 10. In this position window 35 is entirely masked by stop surface 60, against which outer surface 23 of body 22 of key 18 abuts.

The rotation of drum 30 about its axis X—X can be controlled by serrated control wheel 62 connected to drum 30. In the embodiment shown serrated control wheel 62 is integral with drum 30 and is constituted by a series of axial grooves formed on the outer surface of the latter in the vicinity of upper trunnion 52. Serrated wheel 62 is positioned in the upper part of the contour of opening 24 of casing 10 and is thus accessible from outside the case to a driver who wishes to rotate drum 30 about its axis X—X.

Figure 4:
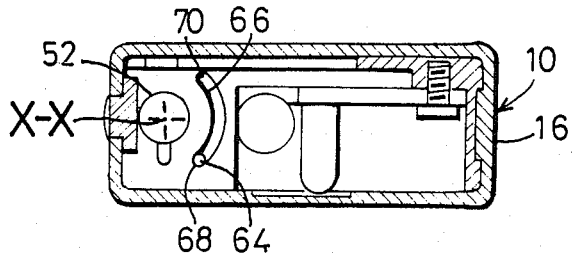
FIG. 4 is a sectional view along line 4—4 of FIG. 1, whereby the key is in its retracted position.
Figure 5:
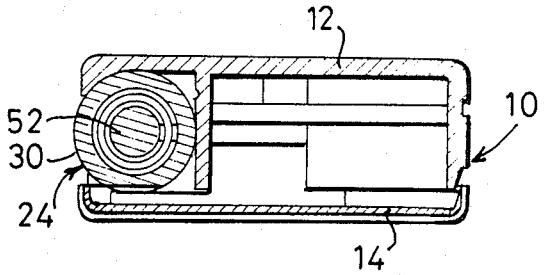
FIG. 5 is a sectional view along line 5—5 of FIG. 1, whereby the key is in its retracted position.

The rotation of drum 30 about its axis X—X is limited by cylindrical stud 64 fixed to drum 30 and extending parallel to the axis of the latter (see FIG. 4). Stud 64 penetrates into stud-hole 66 formed in a circular arc in case 10. The rotation of the drum is thus limited between a first position in which window 35 is opposite stop surface 60 and in which stud 64 abuts against end 68 of stud-hole 66 and a second position in which window 35 is opposite opening 24, whereby stud 64 then abuts against the second end 70 of stud-hole 66. The circular arc of stud-hole 66, delimited by ends 68 and 70 of the latter, describes an angle of 90° which determines the possible rotation through 90° of the drum about its axis X—X.

The means for limiting the rotation of the drum also comprise, in addition to stud 64, return spring 72 which permanently pushes the drum toward the first position defined above, that is, toward the position in which stud 64 abuts against the first end 68 of stud-hole 66. Return spring 72 is a spiral cylindrical spring mounted in axial cylindrical groove 73 formed in drum 30 in the vicinity of upper trunnion 52. A first end 74 of the spring is received in a pierced hole 76 formed at the bottom of cylindrical groove 73. The second end 78 of spring 72 is received in bore 80 formed in case 10. As ends 74 and 78 of spring 72 are thus fixed to drum 30 and to case 10, spring 72 permanently exerts an elastic force of rotation on drum 30.

In order to allow another key (not shown), such as, for example, the ignition key of the vehicle to be attached, case 10 is provided with a ring 82 hooked onto stud 84 of case 10.

The operation of the retractable key carrier will now be described.

Figure 8:
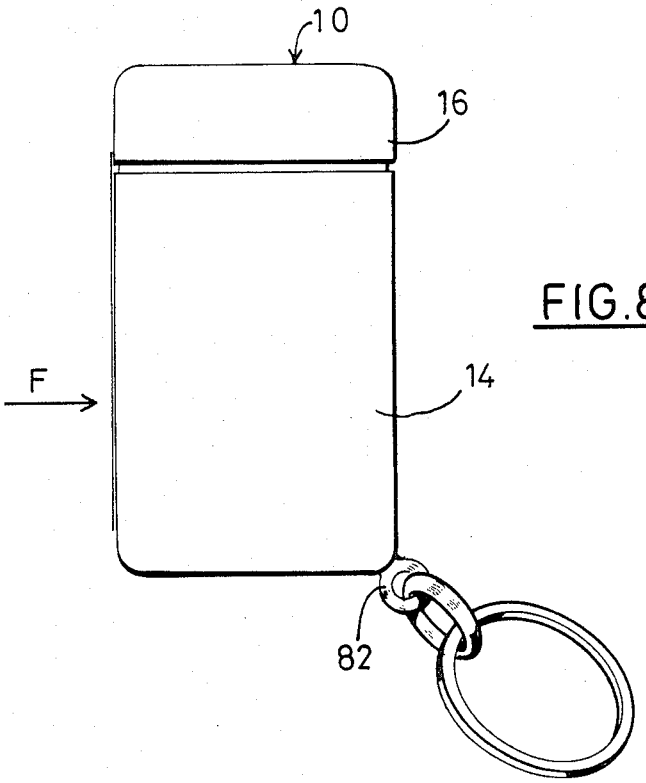
FIG. 8 is a general outer view of the key carrier of FIG. 1, whereby the key is in its retracted position.
Figure 9:
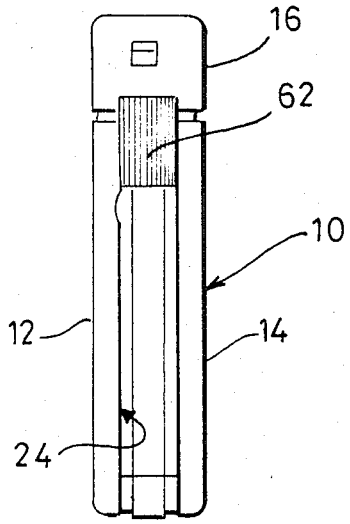
FIG. 9 is a side view in the direction of arrow F of FIG. 8.

If the infrared wave transmitter incorporated in case 10 breaks down, the user can withdraw the key which is retracted in case 10, case 10 having an outer shape shown in FIGS. 8 and 9.

Figure 7:
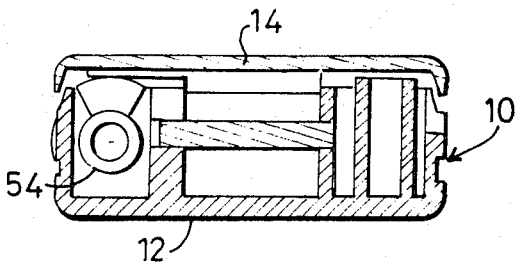
FIG. 7 is a sectional view along line 7—7 of FIG. 1, whereby the key is in its retracted position.

The user can turn serrated control wheel 62 counterclockwise with respect to the position of FIG. 7 in order to rotate the drum against the elastic rotational force exerted by return spring 72. The drum may be rotated from the first position defined above through an angle of 90° until it occupies the second position defined above. As soon as this position has been reached, that is, as soon as window 35 is opposite to opening 24, key 18 pivots automatically about its pin 28 under the action of the elastic rotational force exerted on key body 22 by spiral spring 38. The key then pivots until it occupies its extended position shown in FIG. 1. The user can then use emergency key 18 while using case 10 as a gripping head for key 18.

When the user wishes to retract key 18 into case 10, he can make body 22 pivot about pin 28 by pushing on it against the elastic force exerted by spring 38 until the key occupies its fully retracted position 18" shown in FIG. 1. In this fully retracted position body 22 of key 18 is completely withdrawn into space 35 formed in drum 34 and nothing prevents the drum from rotating clockwise about its pin (in relation to the position of FIG. 6)under the action of return spring 72. The drum rotates until it reoccupies the first position defined above, in which position stud 64 abuts against end 68 of stud-hole 66 and in which position key body 22 abuts against surface 60 of case 10, which completely masks window 35. The key is again completely retracted and no longer visible from outside the case.

The invention is not limited to the embodiment described. In particular, the key body could pivot by 180° in order to occupy an exit position parallel to the axis of the infrared bulb.

What is claimed as new and desired to be secured by Letters Patent of the United States is:

1. A key carrier comprising:

a hollow case having a first opening;

a hollow drum having first and second ends, said hollow drum mounted in said case adjacent said first opening such that said first and second ends of said drum are enclosed by said case, said drum having a second opening and being rotatably mounted about a first axis, whereby said drum may be rotated such that said first and second openings are in alignment;

a pin mounted in said drum to define a second axis perpendicular to said first axis;

a key pivotally mounted on said pin for movement between a first position wherein said key is positioned in said drum, and a second position wherein said key extends out of said drum;

first means for biasing said key into said second position;

second means for biasing said drum such that said first and second openings are out of alignment; and means for permitting manual rotation of said drum, whereby said key is retained in said first position by said case when said first and second openings are biased out of alignment by said second biasing means, wherein rotation of said drum by said manual rotation means such that said first and second openings are in alignment permits said first biasing means to move said key into said second position, and wherein said second biasing means moves said first and second openings out of alignment when said key is returned to said first position.

2. The carrier of claim 1 wherein said first means for biasing comprise a spiral spring wound about said pin, said spiral spring having a first end engaging said drum and a second end engaging said key.

3. The carrier of claim 2 wherein said spiral spring is positioned within said drum.

4. The carrier of claim 1 wherein said case includes a stop surface against which said key abuts for retaining said key in said first position when said first and second openings are out of alignment.

5. The carrier of claim 1 wherein said manual rotation means comprises a serrated control wheel fixed to said drum.

6. The carrier of claim 1 including means for limiting the angle of rotation of said drum.

7. The carrier of claim 6 wherein said means for limiting comprise:

a stud hole formed in said case, said stud hole defining an elongate arcuate shape and having two ends; and a stud fixed to said drum and positioned in said stud hole, the rotation of said drum being limited by contact between said stud and said ends of said stud hole.

8. The carrier of claim 1 wherein said drum includes an axial cylindrical groove, said second biasing means comprising a spiral spring mounted in said groove and having a first end engaging said drum and a second end engaging said case.

9. The carrier of claim 1 including an electromagnetic signal transmitter positioned in said case.

* * * * *